US005401196A

United States Patent [19]

Triantafyllou et al.

[11] Patent Number: 5,401,196

[45] Date of Patent: Mar. 28, 1995

[54] PROPULSION MECHANISM EMPLOYING FLAPPING FOILS

[75] Inventors: Michael S. Triantafyllou, Belmont; David S. Barrett, Needham, both of Mass.

[73] Assignee: Massachusetts Institute of Technology, Cambridge, Mass.

[21] Appl. No.: 154,260

[22] Filed: Nov. 18, 1993

[51] Int. Cl.[6] ..... B63H 1/36

[52] U.S. Cl. ..... 440/13; 416/83; 440/14

[58] Field of Search ..... 440/13–15; 416/79, 81, 82, 83

[56] References Cited

U.S. PATENT DOCUMENTS

| | | | |
|---|---|---|---|
| 4,490,119 | 12/1984 | Young | 440/14 |
| 5,000,706 | 3/1991 | Wang | 440/14 |
| 5,021,015 | 6/1991 | Wang | 440/13 |

FOREIGN PATENT DOCUMENTS

| | | | |
|---|---|---|---|
| 3701151 | 7/1988 | Germany | 440/13 |

OTHER PUBLICATIONS

M. S. Triantafyllou, et al, Wake Mechanics for Thrust Generation in Oscillating Foils, Dec. 1991, pp. 2835–2837, American Institute of Physics, Phys. Fluids A3 (12).

G. S. Triantafyliou, et al, Optimal Thrust Development in Oscillating Foils with Application to Fish Propulsion, pp. 205–224, Journal of Fluids and Structures 1993.

*Primary Examiner*—Sherman Basinger

*Attorney, Agent, or Firm*—Wolf, Greenfield & Sacks

[57] ABSTRACT

A propulsion system for use in a fluid, the system utilizing at least one foil which is both oscillated at a frequency f with an amplitude a in a direction substantially transverse to the propulsion direction and flapped or pitched about a pivot point to change the foil pitch angle to the selected direction of motion with a smooth periodic motion. Parameters of the system including Strouhal number, angle of attack, ratio of the distance to the foil pivot point from the leading edge of the foil to the chord length, the ratio of the amplitude of oscillation to the foil chord width and the phase angle between heave and pitch are all selected so as to optimize the drive efficiency of the foil system.

24 Claims, 7 Drawing Sheets

PROPULSION MECHANISM EMPLOYING FLAPPING FOILS

This invention was made with government support under Contract Numbers NA86AA-D-SG089 and NA90AA-D-SG424 awarded by the U.S. Department of Commerce and Grant Number N00014-92-J-1726 awarded by the Navy. The government has certain rights in the invention.

FIELD OF THE INVENTION

This invention relates to propulsion mechanisms and more particularly to marine propulsion mechanisms employing flapping foils.

Background of the Invention

Heretofore, the most efficient form of marine propulsion has been a propeller. Other forms of marine propulsion such as paddle wheels operate at much lower efficiencies. However, propellers while having a long reliable record, are not an ideal marine propulsion mechanism. First, even under ideal conditions, the efficiency of propellers is seldom over 80%, and under heavy loads, particularly where there are constraints on propeller diameter, the efficiency may be barely above 40%. Second, to achieve reasonable efficiencies, propellers require a fairly deep draft. This is not always practical in applications such as underwater vehicles, shallow draft vessels, vessels with side-ship thrusters, very fast boats, etc. Propellers are also relatively noisy, which may be undesirable in certain covert applications such as submarines, for open pleasure boats, or in other situations where there is a desire to minimize noise pollution. Finally, propellers can only be utilized to propel the vessel. A separate rudder system is generally required to steer the vessel. It would be preferable if a single propulsion mechanism could be utilized to perform both the drive and steering functions.

In looking for improved propulsion systems, and in particular systems adapted for marine propulsion, one area of exploration has been flapping foils, such foils being considered promising because of their similarity to the propulsion system utilized by fish. However, the efficiency previously achieved by use of flapping foils (i.e. the useful energy for propulsion divided by the energy spent) has generally been substantially less than that achieved by a propeller under most conditions, such foil efficiency typically being in the 65% range under ideal conditions.

It has been found that one reason for this low efficiency in prior foil systems is that they have failed to take into account The formation in the wake of the foil of large vortices and have failed to otherwise optimize the parameters of the foils and of the remainder of the mechanism. A need therefore exists for an improved propulsion mechanism utilizing flapping foils.

SUMMARY OF THE INVENTION

In accordance with the teachings of this invention, a propulsion mechanism for use in a fluid is provided which utilizes at least one foil to propel a vessel at a forward speed (U). The foil(s) is/are both oscillated at a frequency (f) with an amplitude (a) in a direction substantially transverse to the propulsion direction and flapped about a pivot point to change the foil pitch angle to the selected direction of motion with a smooth periodic motion. The flapping is preferably at substantially the same frequency (f) as the oscillation and is performed through an angle from $+\theta°$ to $-\theta°$ with there being a phase angle $\psi$ between the pitch angle of the foil and its transverse oscillation. Each foil should have an average chord (c), an average span (S) and a pivot point spaced by a distance (b) from the leading edge of the foil. The total excursion A of the trailing edge of the foil should be given approximately as:

$$A = 2\sqrt{a^2 + (c-b)^2 - 2a(c-b)\cos\psi}\ .$$

In order to minimize the adverse effects of vortices on foil efficiency, The mechanism should be designed such that it has a Strouhal number $St = fA/U \approx 0.20$ to 0.45 with a preferred value of approximately 0.35. Other parameters of concern in optimizing the efficiency of a foil propulsion mechanism include the nominal angle of attack $\alpha$ which is given approximately by the relation:

$$\alpha \approx \sqrt{\left(\frac{2\pi fa}{U}\right)^2 + \theta^2{}_o - 2\theta_o\frac{2\pi fa}{U}\sin\psi} \approx 10° \text{ to } 22°$$

with a preferred value of approximately 20°;

$b \approx 10\%$ to 40% of c with a preferred value of approximately 33 ⅓% of c;

a/c (the amplitude of oscillation divided by the foil chord) > 1 with a preferred value of approximately 1.5; and $\psi \approx 70°$ to 110° for forward propulsion (and −70° to −110° for reverse propulsion) with a preferred value which varies as a function of b/c, being approximately 75° for forward propulsion (and −75° for reverse propulsion) for b = 0.3 c.

There are preferably a plurality of foils which are oscillated out of phase so that the average thrust of the foils in a direction transverse to the selected direction of motion is substantially zero. Where there are an even number of foils, half the foils are preferably oscillated 180° out-of-phase with the other half of the foils. With a plurality of foils, each pair of adjacent foils are preferably spaced by a minimum distance of approximately 3 c. A vessel being propelled may be steered by adding a bias angle $\bar{\theta}$ to the instantaneous pitch angle for the foils, where $\bar{\theta}$ is substantially 0 for propulsion in the selected direction and may be varied, preferably between angles of ±10° to turn the vessel.

A spring or other suitable mechanism may be utilized to store energy utilized in the oscillating or heave motion of the foil(s) and to return such energy during return strokes to further enhance the efficiency of the mechanism.

In designing the mechanism, a minimum draft (H) may be specified with the foil span (S) being slightly less than H, for example 0.8 H. The combined area $NA_0$ of the N foils should be equal to $C_rA_wNC_t$ where $A_W$ is the wetted area of the vessel and where $C_r$ and $C_t$ are the resistance coefficient of the vessel and the thrust coefficient of the foil(s), respectively. The average chord for each foil would then be given by $c = A_o/S$. The c determined above may then be utilized in equations previously provided to obtain (a) (the amplitude of oscillation). This value, in conjunction with the preferred values for (b) and (c), may then be utilized to determine A (the total excursion of trailing edge) which in conjunction with the desired speed and the preferred Strouhal number may then be utilized to determine the frequency of oscillation.

The foregoing and other objects, features and advantages of the invention will be apparent from the following more particular description of an illustrative embodiment of the invention as illustrated in the accompanying drawings.

IN THE DRAWINGS

DETAILED DESCRIPTION

Figure 1A:
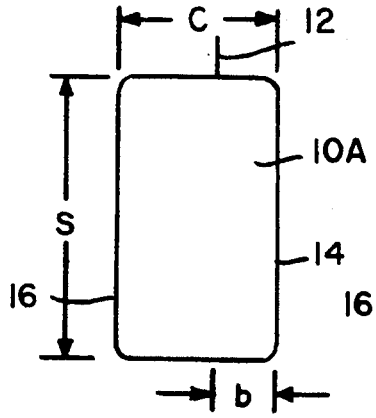
FIG. 1A, FIG. 1B and FIG. 1C are side views of three representative foils suitable for use in practicing the teachings of this invention which are utilized to illustrate various parameters.
Figure 1B:
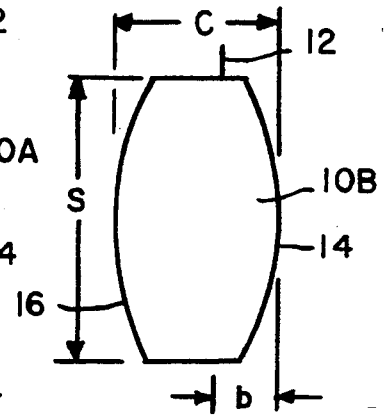
Figure 1C:
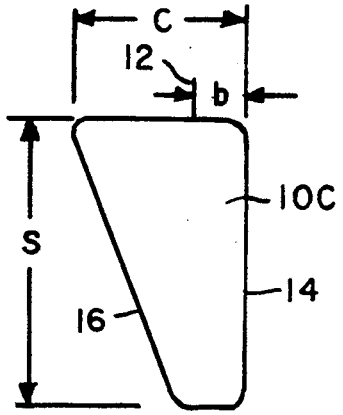
Figure 2:
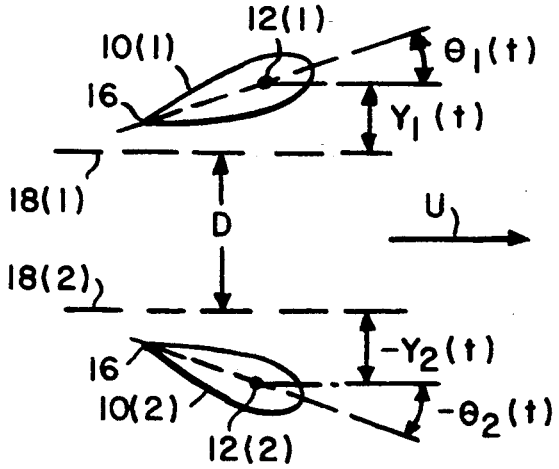
FIG. 2 is a top view of two foils operating in accordance with the teachings of this invention which illustrates additional parameters.

FIGS. 1A, 1B and 1C are side views of illustrative foils 10A,10B and 10C, respectively, having different shapes which may be utilized in practicing the teachings of this invention. FIG. 2 is a top view which might be appropriate for any of the foils 10A, 10B or 10C. The exact shape of the foil used in practicing the teachings of this invention is not critical and will vary with application. Examples of foils suitable for use are NACA type foils, although the invention is not limited to the use of such foils. Where the foil has a substantially rectangular shape as shown for foil 10A, the span S would be substantially the height of the foil and the chord c would be substantially the width of the foil. Where the foil has an irregular shape as is illustrated for example by the foil 10B or 10C, the span S and chord c would be the average height and width, respectively, of the foil. For either foil, the area $A_0$ for the foil is defined as Sc (i.e. the span times the chord).

Each foil is pitched or pivoted about a pivot point 12 which is spaced by a distance b from the leading edge 14 of the foil. Leading edge 14 faces in the direction in which the vessel to which the foil is attached is normally moving. The side opposite leading edge 14 is trailing edge 16.

Referring to FIG. 2, foils 10(1) and 10(2) are spaced at their pivot points 12 by a distance D when both foils are at their center positions 18(1), 18(2), respectively. Each foil is oscillated (i.e. undergoes heave movement) to move its pivot point 12 through a cycle around the corresponding center line 18 in a periodic pattern (which is preferably a sinewave), with the maximum excursions on each side of the center line 18 being by an amount (a). As will be discussed later, (a) is preferably determined as a function of chord length c. The instantaneous position Y(t) of pivot point (b) for each of the foils is determined by the equation $Y(t)=a\sin(2\pi ft)$ for preferred embodiments of the invention. However, while sinusoidal motion is generally most convenient for available drive systems, this is not a limitation on the invention so long as the oscillation is in a smooth, regular, periodic pattern. The motions of the two foils 10(1), 10(2) are preferably 180° out-of-phase with each other so that $Y(t)_{avg}$ for the two foils is always substantially zero. This prevents undesired side thrust on the vessel being driven which could cause a fishtailing effect and the relationship should remain true regardless of the number of foils utilized. For example, if three foils were utilized, the foils would each be 120° out-of-phase so as to maintain the desired average Y(t) of zero.

Figure 3G:
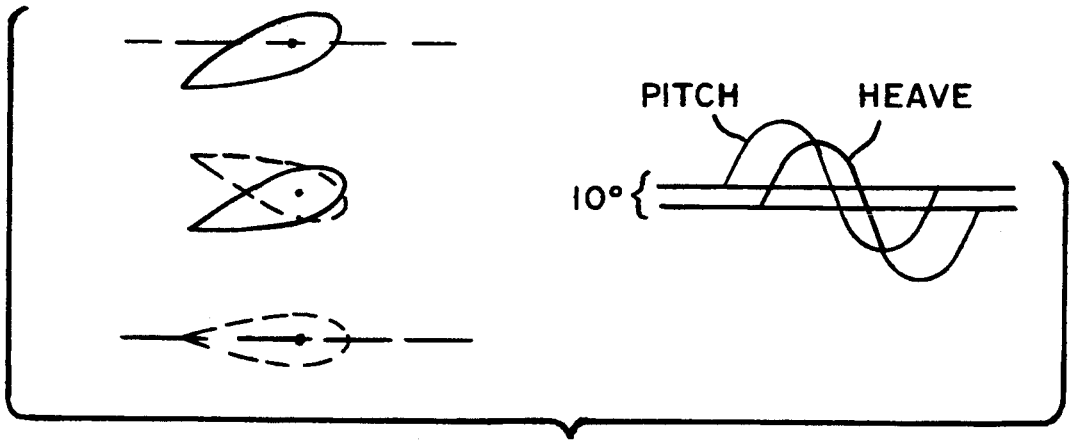
FIGS. 3A–3G are diagrams illustrating the relative heave and pitch positions of a foil for various phase angle differences $\psi$, with FIG. 3G illustrating the situation where there is a $+10°$ bias angle.

Each of the foils also has a $\theta(t)$ relative to the direction of motion U which is determined by the relationship:

$$\theta(t)=\theta_0\sin(2\pi ft+\psi)+\overline{\theta}$$

where: $\psi$=the phase angle between the heave and pitch for the foil and $\overline{\theta}$ is a bias angle. The effect of $\psi$ on drive efficiency and direction of motion will be discussed in connection with FIGS. 3A–3F. $\overline{\theta}$ is 0 for forward motion of the vessel and may be varied, preferably by angles ranging up to $\pm 10°$, to turn the vessel. FIG. 3G illustrates the effect of a $+10°$ bias angle on foil position for a single foil and this effect will be discussed in conjunction with FIG. 3G.

Figure 3A:
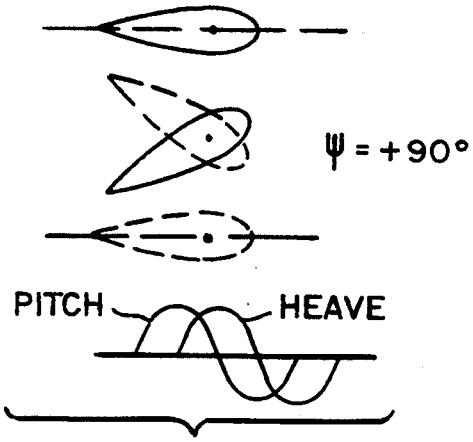
Figure 3D:
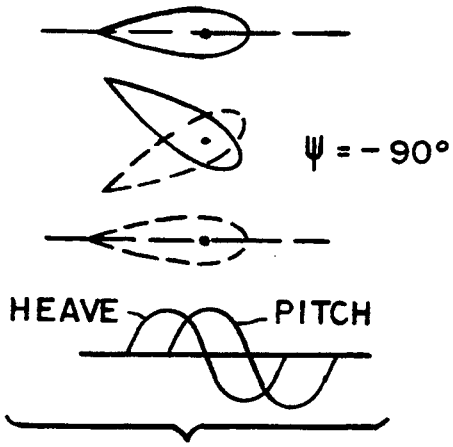

Referring to FIG. 3A, the relationship between heave position and pitch angle is shown for $\psi=90°$. In this situation, the pitch is zero at the maximum extent of the heave or oscillating movement and the pitch is maximum at the midpoint of the oscillation. However, referring both to the foil diagram and to the sine curves which illustrate the relative pitch angle versus heave position, it is seen that the maximum pitch angles are in opposite direction depending on whether the foil is being moved in the positive or negative direction from its midposition.

Figure 3B:
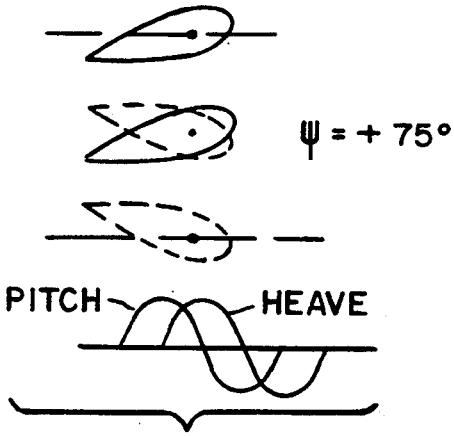
Figure 3E:
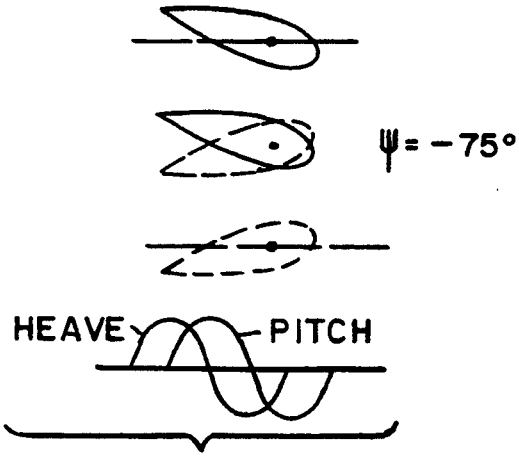

While good results can be obtained with phase angles $\psi$ between roughly $+70°$ and $+120°$ when moving in a forward direction, it has been found that optimum results are achieved for a particular phase angle which varies with the value of the ratio b/c. For b=0.3 c, the optimum phase angle is approximately $+75°$. FIG. 3B illustrates the situation with a $+75°$ phase angle. For this phase angle, the maximum pitch occurs slightly beyond the center or zero position for the oscillation in each direction and the pitch angle does not quite reach zero at the extremes of the heave movement, zero pitch angle occurring as the foil starts to move back toward its center position.

Figure 3C:
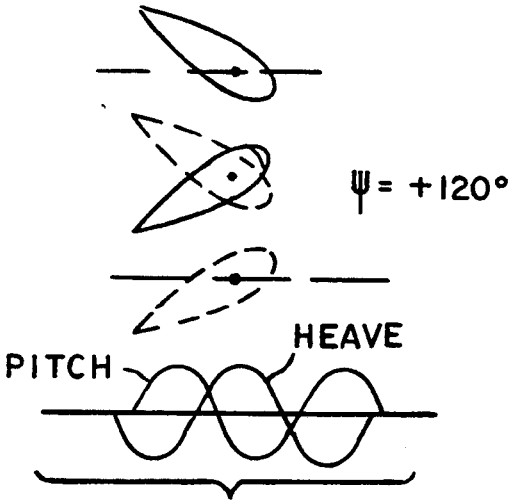
Figure 3F:
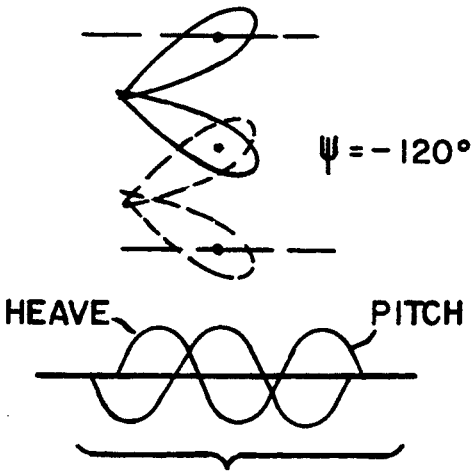

FIG. 3C illustrates the situation where the phase angle $\psi$ is $+120°$. In this situation, the maximum pitch angle occurs prior to the midpoint of each heave or oscillation cycle in each direction and the zero pitch angle occurs prior to the foil reaching the extremes of its oscillations. Thus, at the maximum heave positions, the foil has already started to move in the opposite direction from that in which it was moving during most of the corresponding heave movement.

The phase angles shown in FIGS. 3A–3C result in the vessel being driven by the foil being moved in a forward direction. The negative phase angles shown for FIGS.

3D–3F result in the vessel being moved backward. In each of these cases, there is a negative phase angle so that the relationship between heave and pitch is the reverse of that shown for the corresponding phase angles in FIGS. 3A–3C, respectively. Thus, referring to FIG. 3D, it is seen that the pitch angles at both extremes of the heave or oscillation for the foil are the same as for FIG. 3A, namely, 0°, but that the maximum pitch angle positions at the midpoint of the heave excursions are reversed. Similar reversals of pitch angle at various points in the excursion are shown when comparing FIGS. 3B and 3E which show the +75° and −75° phase angles and FIGS. 3C and 3F which illustrate the situations with a +120° and −120° phase angle, respectively.

FIG. 3G illustrates the situation where a bias angle of +10° is superimposed on the $\psi=75°$ configuration, this being done to cause the vessel to turn in the positive direction (i.e. to turn to the left as shown in the figures). Thus, for each position of the foil during its heave cycle, the pitch angle is 10° greater than it would be for the comparable phase angle and heave position without the bias angle. This results in the average position of the foil having a 10° bias in the positive direction and has the same effect on the direction of motion for the vessel as if there was a rudder on the rear of the vessel which was positioned with a +10° angle. A turn in the negative direction (i.e. a turn to the right) may be effected by imposing for example up to a −10° bias angle on the foil. The actual bias angle will vary depending on how sharp a turn is desired for the vessel, a larger bias angle resulting in a sharper turn. Therefore, a foil propulsion system is provided which enables a vessel being propelled by the system to move either forward or backward and to be turned in a desired direction when moving in either direction.

As previously discussed, this invention has discovered that in order to enhance the operation of a foil-driven propulsion system, a number of relationships are important. While improvements in performance can be achieved by utilizing any one of these relationships, optimum performance of the system is achieved where all of the relationship are simultaneously employed.

In particular, in order to minimize the adverse effect of vortices on foil efficiency, the mechanism should be designed such that it has a Strouhal number $St=fA/U\approx 0.20$ to 0.40 with a preferred value of approximately 0.35, FIG, 6A illustrates the relationship between Strouhal number and efficiency for a foil which has the general shape of that shown in FIG. 1A. The curves are for various nominal angles of attach $\alpha$ with all but the last two curves being for a phase angle of 90°. The last two curves are at the phase angles indicated with a nominal angle of attach of 20°. The data was collected for $a/c=1.5$.

Other parameters of concern in optimizing the efficiency of a foil propulsion system are the nominal angle of attack $\alpha$ which is given approximately by the relation:

$$\alpha \simeq \sqrt{\left(\frac{2\pi fa}{U}\right)^2 + \theta^2_o - 2\theta_o\frac{2\pi fa}{U}\sin\psi} \simeq 10° \text{ to } 22°$$

with a preferred value of approximately 20°;

$b\approx 10\%$ to 40% of c with a preferred value of approximately 33 ⅓% of c;

a/c (the amplitude of oscillation divided by the foil chord)>1 with a preferred value of approximately 1.5 (note that the nature of a and c will limit this value to probably not much over 3); and $\psi\approx 70°$ to 110° for forward propulsion (and −70° to −110° for reverse propulsion) with preferred values as previously discussed.

FIGS. 4A–4B and 5A–5C illustrate a possible implementation for a foil propulsion system in accordance with the teachings of the invention. This embodiment is illustrated with respect to a marine propulsion application wherein a vessel 30, portions at the stern end of which are shown diagrammatically in the figures, is driven by a pair of foils 10(1) and 10(2). Each foil is suspended from the hull 32 of the vessel by a corresponding shaft 34(1),34(2). Each shaft 34 passes through a corresponding slit 36(1),36(2) in hull 32, the extent of the slots 36 as viewed in FIG. 4A and as illustrated by the arrows 38 being greater than the total maximum heave amplitude for the foils. Each shaft 36 is fixed to a corresponding table 40(1),40(2). As may be best seen in FIG. 4B, each table 40 has two or more wheels or rollers 42 mounted to the forward underside and to the rear underside, which wheels or rollers ride in corresponding tracks 44 mounted to hull 32. Tables 40 and the foils 10 attached thereto are thus free to move in the direction 38, but are not free to move in any other direction.

Figure 4A:
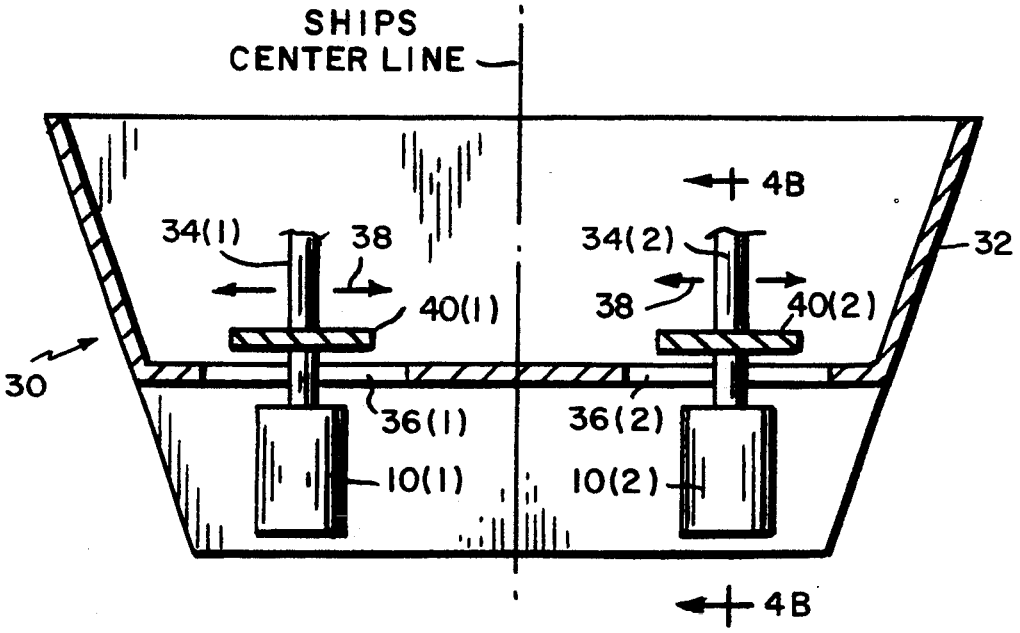
FIG. 4A is a diagrammatic rear view of an illustrative embodiment of a marine propulsion system in accordance with the teachings of this invention.
Figure 4B:
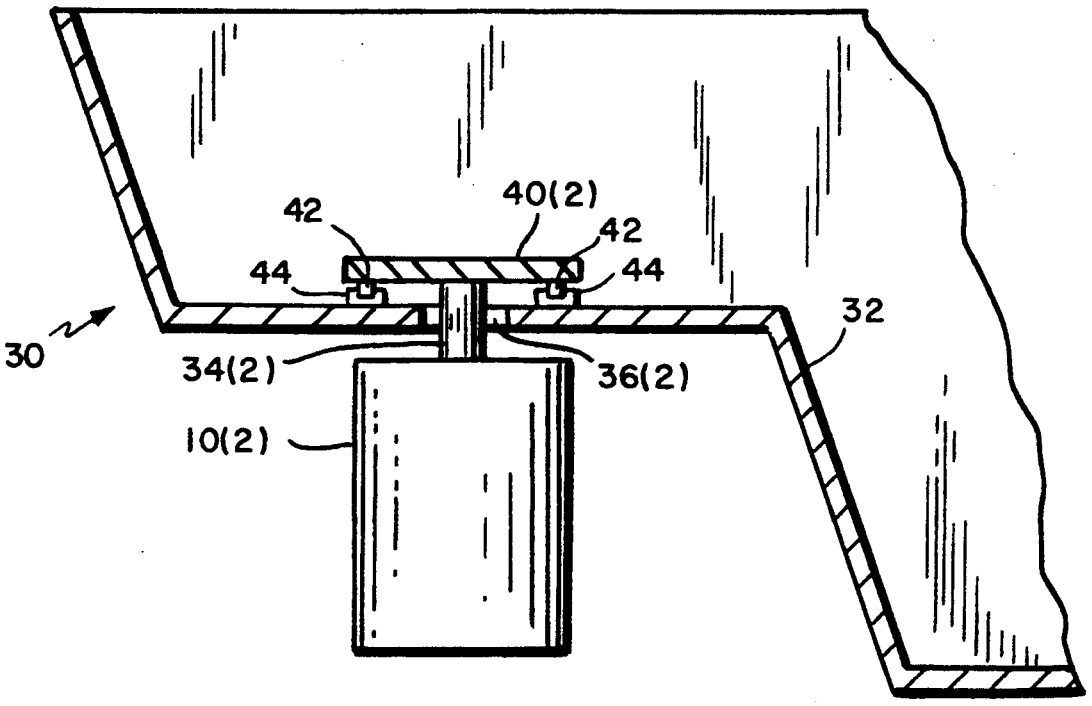
FIG. 4B is a diagrammatic side view taken generally along the line B—B in FIG. 4A.
Figure 5A:
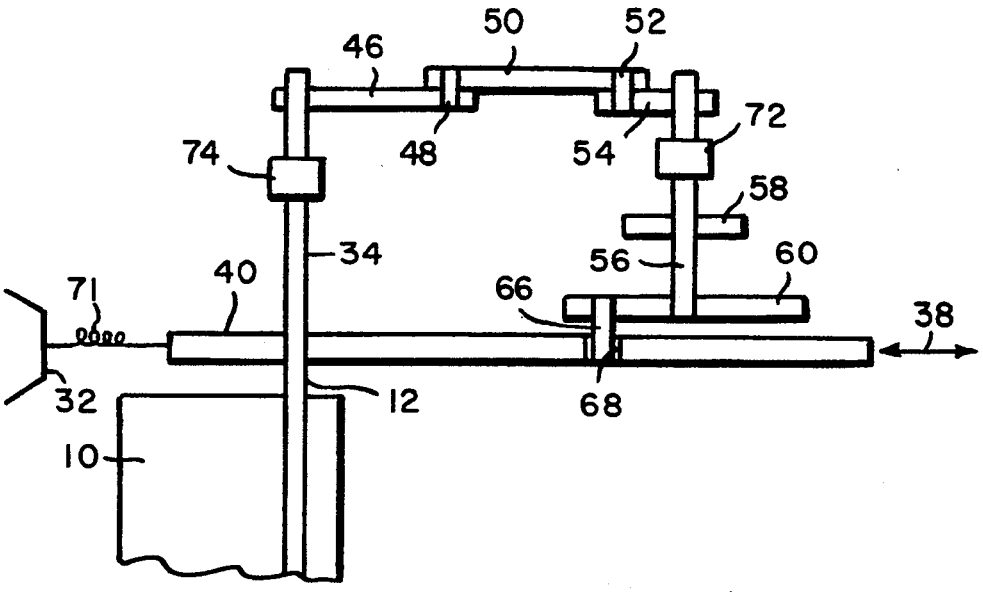
FIGS. 5A–5C are more detailed rear, side and top views, respectively, for a marine drive system of the type shown in FIGS. 4A and 4B.
Figure 5B:
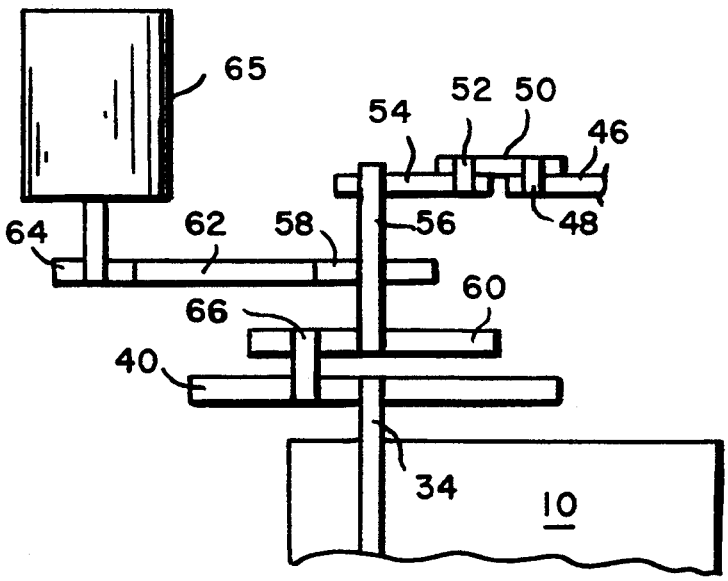
Figure 5C:
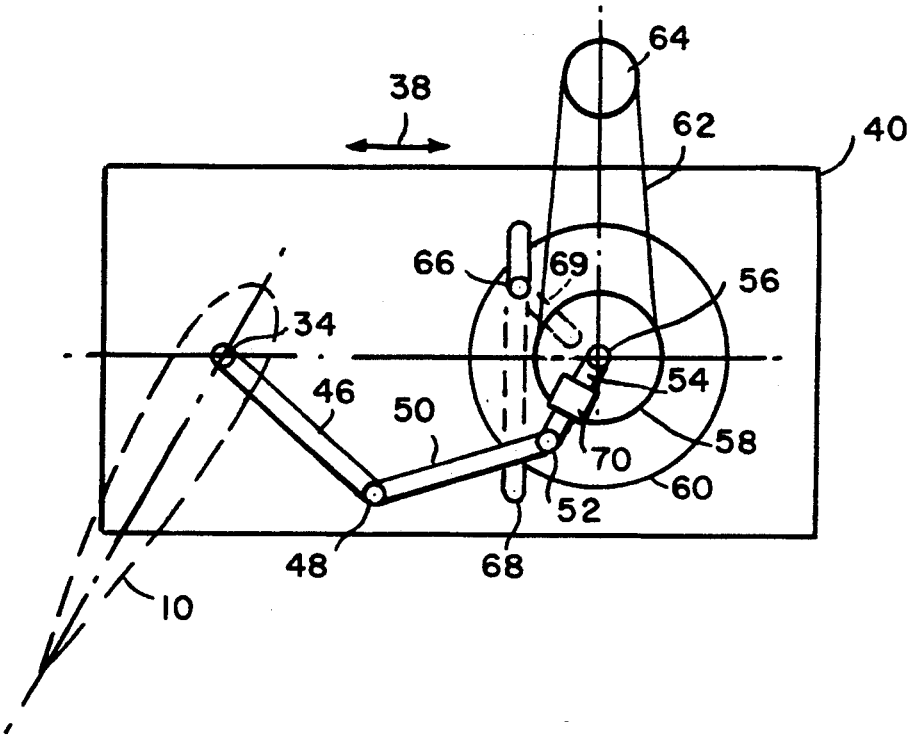

FIGS. 5A–5C illustrate the mechanism for driving one of the foils shown in FIGS. 4A–4B, it being understood that the mechanism of FIGS. 5A–5C would be repeated for each of the foils. From FIGS. 5A–5C, it is seen that in addition to being attached to table 40, shaft 34 is also rigidly attached to one end of an arm 46, the other end of which is rotatably attached by a pin 48 to one end of an arm 50. The other end of arm 50 is attached by a pin 52 to one end of an arm 54, the other end of arm 54 being rigidly attached to a shaft 56. Shaft 56 also has attached thereto a wheel or disk 58 and a wheel 60. Wheel 58 is attached by a belt 62 to be rotated by a motor 65 via a wheel 64 mounted to the motor shaft. Wheel 60 has a pin 66 extended from a selected point thereon, which pin rides in a slot 68 formed in table 40, slot 68 extending in a direction generally perpendicular to direction 38.

In operation, as motor 65 causes wheel 58 and thus shaft 56 to rotate in a given direction (either clockwise or counterclockwise being equally effective), wheel 60 attached to shaft 56 also rotates through a 360° rotation. As wheel 60 rotates, pin 66 is also rotated. The movement of pin 66 in slot 68 causes table 40 to have a generally sinusoidal movement in direction 38. Since shaft 34 to which foil 10 is mounted is attached to move with table 40, foil 10 also moves in direction 38 with a generally sinusoidal movement imparting the desired heave motion to the foil.

The rotation of shaft 56 also causes arm 54 which is fixed thereto to rotate through a 360° path. This motion is imparted to arm 46 through arm 50, causing angular variations in the direction of arm 46 which result in angular rotations of shaft 34. Rotations of shaft 34 are imparted to foil 10 attached thereto, resulting in the desired pitch variations of the foil during its heave motion. The rotation of motor 65 is thus converted into the desired heave and pitch motion of the foil by the mechanism shown in FIGS. 5A–5C.

Since each of the foils 10(1),10(2) is driven by a separate motor 65, it is desirable that these motors be maintained in synchronism to achieve optimum propulsion and to avoid side thrust forces. The motors may be maintained in synchronism utilizing standard motor synchronization techniques such as, for example, utilizing a feedback output from one of the motors, the master motor, to maintain the other motor, the slave motor, in synchronization therewith. With other types of drive arrangements, or by suitably orienting components, a drive system may be designed which permits both foils to be driven from a single motor, eliminating the synchronization requirement. Various considerations will determine whether the additional complexity in drive linkages required to operate two or more foils from a single motor is advantageous over utilizing a separate motor for each foil and providing suitable synchronization circuitry for such motors.

FIG. 5A also shows a spring 71 attached at one end to table 40 and attached at the other end to the hull 32 or to some member fixed to the hull. Spring 71 is preferably installed such that it is in its neutral position when table 40 is at the midpoint of its travel path so that the spring is stretched when the table is to the right of such center point as viewed in FIG. 5A and is in compression when the table is to the left of the center point. The spring thus stores energy when the table is moving away from its center position and gives back energy when the table is moving back toward its center position. This storage and giving back of energy enhances the overall efficiency of the system.

When the spring, and the mass of the table (plus all other moving equipment) have a natural frequency which is near the operating frequency f for the system, optimal use of the spring is achieved. Since the frequency f varies with the speed at which the vessel is moving, the spring is typically designed to achieve optimal operation at the frequency for the normal cruising speed of the vessel since this is the frequency at which the system will most often be operating. While only a single spring is shown in FIG. 5A, it is to be understood that an additional spring may be provided on the opposite side of table 40 from spring 71 to provide more balanced forces and that additional springs 71 may also be provided. Other mechanisms known in the art which are adapted to store and return energy might also be used in place of springs 71 to achieve this function. Where the use of such mechanism is potentially detrimental at non-resonant frequencies, suitable mechanisms may be provided to disable the energy storing mechanism until the vessel reaches its normal cruising speed so that the mechanism is most effectively utilized.

The amplitude (a) of the heave motion is roughly equal to the distance between shaft 56 and pin 66 and may thus be controlled by varying this distance. This may be achieved by moving pin 66 along a radius line of wheel 60 either toward or away from shaft 56, either under manual or computer control, until the spacing is suitable to provide the desired heave amplitude. Pin 66 could for example be positioned in a radial slot 69 in wheel 60 as shown in FIG. 5C to permit the amplitude heave adjustment.

The maximum pitch angles $\theta_0$ are determined by the ratio of the length of arm 54 to the length of arm 46. This ratio may thus be controlled by varying the length of either arm 46 or arm 54, the control being illustrated in FIG. 5C by a pneumatic or hydraulic joint 70 in arm 54 which may be utilized under either manual or computer control to vary the length of this arm. Alternatively, a similar joint may be placed in arm 46.

The phase angle may be changed by varying the angular position on wheel 60 of pin 66 relative to the angular position of arm 54. Stated another way, this is accomplished by varying the angular position of arm 54 on shaft 56. This adjustment may be accomplished, for example, by providing a small stepping motor 72 in shaft 56 as shown in FIG. 5A to permit the relative angular position of the upper part of this shaft to which arm 54 is pinned or otherwise connected to the lower part of this shaft to which wheel 60 is connected. Stepping motor 72 may be controlled either manually or by computer. Other suitable means might be provided for permitting controlled rotation of arm 54 on shaft 56. As discussed earlier, vessel 30 moves forward for positive phase angles and will move backward for negative phase angles.

Finally, by rotating the axis of foil 10 relative to the direction of arm 46, a bias angle can be imparted to the system. Again, referring to FIG. 5A, this objective may be accomplished by providing a small stepping motor 74 in shaft 34 to cause a controlled rotation of the upper part of this shaft to which arm 46 is connected from the lower part of the shaft to which foil 10 is connected at its pivot point 12. The amount of this change and the direction of this change will correspond to the desired bias angle. This change would typically be made under computer control based on the desired turn which is inputted into the system, but could also be accomplished in response to a manual input. Other techniques for permitting controlled rotation of arm 46 or foil 10 relative to shaft 34 and/or to the other element could also be utilized to effect the bias control.

While two foils mounted to the stern of the vessel 30 have been shown in the figures, this is not a limitation on the invention and the number and placement of foils will typically depend on the type of vessel, including size and weight, required speed, the use of the vessel, including available draft, wetted areas, speed requirements and available locations for the foils. Thus, while an even number of foils is desirable in that it permits the balancing of side thrust forces by merely having the heave for half the foils be 180° out-of-phase with the heave for the remaining foils, this objective can be obtained in other ways. For example, with three foils, each foil could be 120° out-of-phase with the other foils to provide the desired balanced forces. While a single foil will result in lateral forces being applied to the vessel, if the weight of the vessel is great enough and the oscillating frequencies of the foil is high enough, the inertia of the vessel will be sufficient to damp the side thrust forces and prevent such forces from causing a "tail-wagging" effect on the vessel. Further, while the foils have been assumed to be identical in the discussion so far, and the foils would typically be identical for most applications, there are special situations where the use of foils which are non-identical would be preferable. Such situations might arise, for example, with a vessel having an odd number of foils or where there is some non-symmetry in the vessel or in the foil placement which may be most effectively compensated for by differences in foil size or shape.

In designing foils 10 for use in practicing the teachings of this invention, a curve for a resistance value R versus speed U for the vehicle is determined from the relationship:

$$R=\tfrac{1}{2}(\rho C_r A_w U^2)$$

where $\rho$ is the density of water, $C_r$ is a resistance coefficient for the vessel which may be determined experimentally or may be estimated for a particular vessel based on its size and shape, and $A_w$ is the wetted area of the vessel, which area will vary with load.

The resistance force R is countered by the thrust of the foils. Assuming there are two foils with each of the foils having a thrust T, R=2T, where $T=\frac{1}{2}(\rho C_t A_0 U^2)$.

Figure 6A:
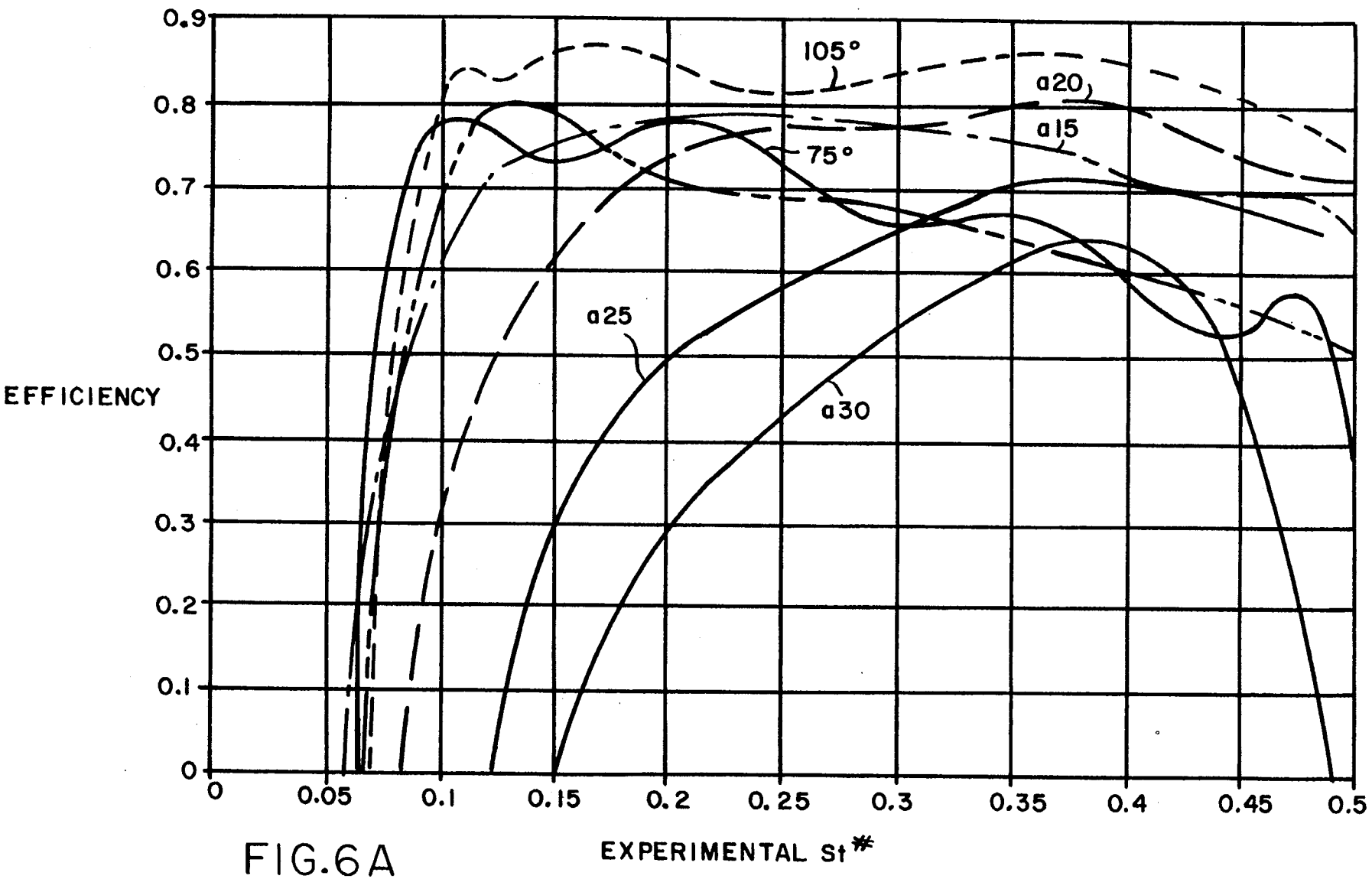
FIG. 6A is a chart illustrating the relationship between Strouhal number St and efficiency for a representative foil under various operating conditions.
Figure 6B:
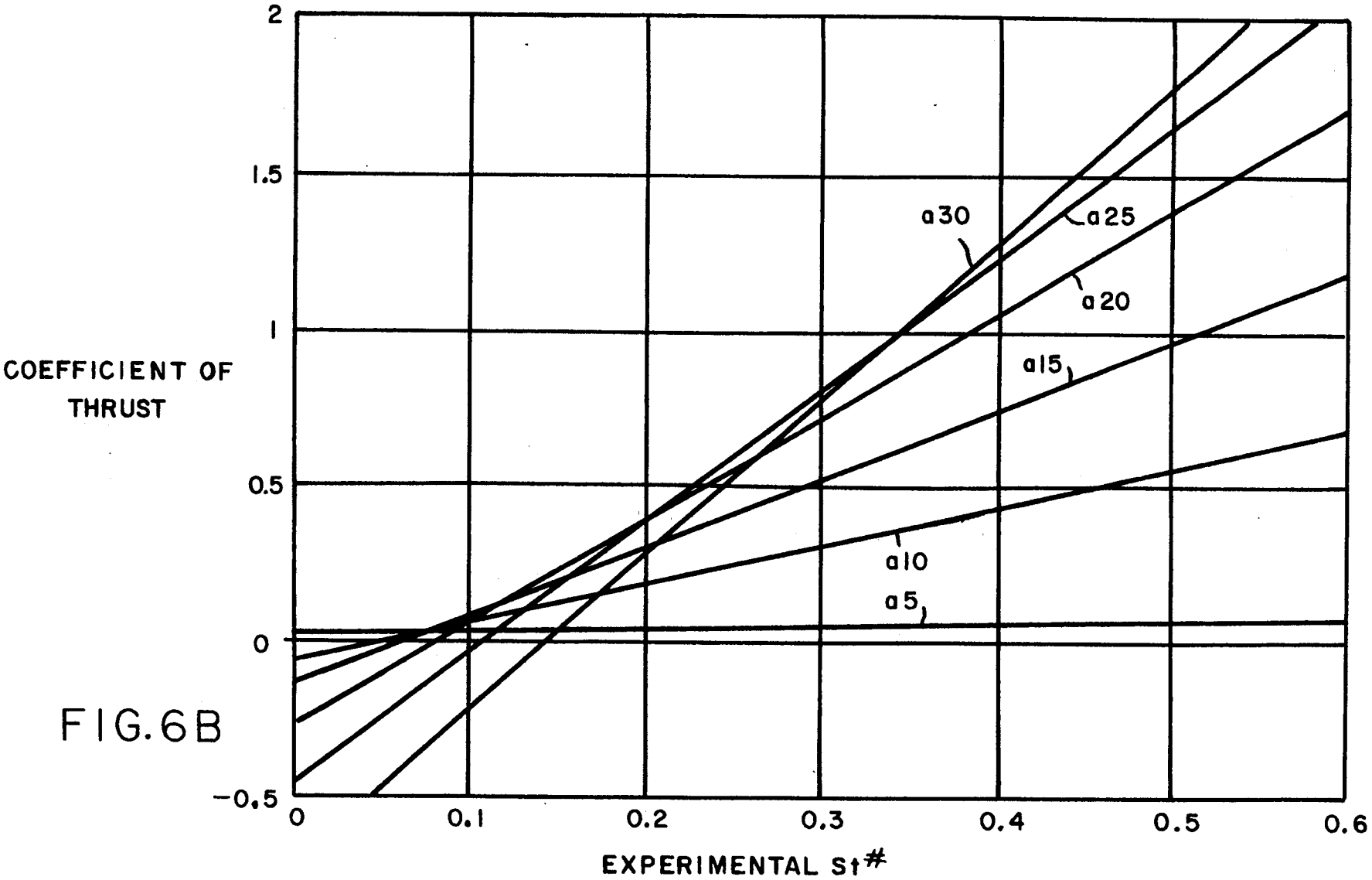
FIG. 6B is a chart illustrating the relationship between Strouhal number and coefficient of thrust for a representative foil under various operating conditions.

In the above equation, $C_t$ is the thrust coefficient for a single foil, which coefficient is a function of foil shape and other factors and may be obtained from tests on the foil or estimated from similar prior used foils. Tables can be developed to provide $C_t$ for common foil types. FIG. 6B illustrates coefficience of thrust as a function of Strouhal number for nominal angles of attack $\alpha$ for a foil of the type shown in FIG. 1C. The data for FIG. 6B was taken with a/c=1.5. Similar charts could be developed for determining the coefficient of thrust for other foil shapes.

$A_0$ is the area of a single foil. $A_0$ is thus defined by $A_0=Sc$. Therefore, with two foils, $C_r A_w = C_t 2A_0$. Since $C_r$ and $A_w$ are given from the vessel design and $C_t$ may be selected or estimated from charts developed for foils, $A_0$ may be found for a given vessel and foil type from the above equation. Usually a minimum draft H is specified for a vessel and the span S may be set to be slightly less than this draft (for example, S~0.80 H). Other criteria may be utilized to select S where H is relatively large. Once the span has been selected for a foil, the chord or average chord may be easily determined from the relationship $c=A_o/S$.

Once the chord c for the foil has been determined above, the offset b to the pivot point (FIGS. 1A, 1B and 1C) may be determined so as to be within the range previously specified (most likely value b/c~0.3).

Next, the amplitude of oscillation a is determined from the chord c from the relationship 2a~3c. It is noted that this equation gives a maximum value of amplitude beyond which there may be some interaction between the foils and an amplitude less than the value given above may be utilized.

Phase angle $\psi$ is selected to be within the recommended range, with +75° being the preferred value were b/c~0.3. Similarly, the angle of attack $\alpha$ is selected to be within the recommended range with a preferred value of approximately 20°. This value along with the other values previously determined may be utilized to determine the maximum pitch angle $\theta_0$ for the foil from the relationship.

$$\theta_o \simeq \frac{2\pi fa}{U}\sin\psi - \sqrt{\alpha^2 - \left(\frac{2\pi Fa}{U}\right)\cos\psi^2}$$

Finally, the frequency f is found by choosing the Strouhal number in the recommended range, preferably about 0.35, from the relationship $$f \simeq \frac{(St)\,U}{2\sqrt{a^2 + (c-b)^2 - 2a(c-b)\cos\psi}}$$

While in the discussion above it has been assumed that the foils are being used as part of a marine propulsion system, and this is clearly the preferred application of the invention, it might also be possible to utilize the invention in place of a propeller in propelling vehicles in fluids (i.e. liquids or gases) other than water. Further, while a motor or engine-driven vehicle has been assumed for the preferred embodiment, the invention may also be advantageously utilized in human powered systems with motions of a swimmer's legs being converted by suitable mechanical linkages into heave and pitch motion for one or more foils in accordance with the teachings of this invention. Such devices can provide faster motion with less exertion than currently available systems for propelling a swimmer or diver without a drive motor.

Thus, a relatively simple, highly efficient, flexible and relatively quiet propulsion system has been provided which can be utilized for a variety of applications including applications in marine propulsion. While a particular mechanism has been shown for implementing this invention, it is to be understood that this implementation is by way of example only and that other implementations complying with the teachings of this invention may be utilized. For example, separate drives may be provided for heave and pitch motion and, depending on the motor or engine utilized, other mechanical linkages may be preferable for converting motion of the motor into heave and pitch for the foils. Thus, while the invention has been particularly shown and described above with reference to a preferred embodiment, the foregoing and other changes in form and detail may be made therein by one skilled in the art without departing from the spirit and scope of the invention.

What is claimed is:

1. Apparatus for providing propulsion in a fluid, said propulsion being in a selected direction at a speed U, comprising:

at least one foil having an average chord c, an average span S, a leading edge facing on average in said selected direction, a trailing edge facing in a direction opposite said leading edge and a pivot point spaced by a distance b from said leading edge;

a heave mechanism for oscillating said at least one foil at a frequency f and with an amplitude a in a direction substantially transverse to said selected direction; and a pitch mechanism for flapping said at least one foil about its pivot point to change its pitch angle to said selected direction with a smooth periodic motion at substantially said frequency f through an angle from $+\theta_o$ to $-\theta 0_o$, there being a phase angle $\psi$ between the pitch angle of the foil and its transverse oscillation, and the total excursion A of the trailing edge of the foil being such that $$A \simeq 2\sqrt{a^2 + (c-b)^2 - 2a(c-b)\cos\psi}\ ;$$

the apparatus substantially conforming to at least one of the following relationships:

$$\alpha \simeq \sqrt{\left(\frac{2\pi fa}{U}\right)^2 + \theta^2{}_o - 2\theta_o\frac{2\pi fa}{U}\sin\psi} \simeq 10° \text{ to } 22° \quad (1)$$

where $\alpha$ is the nominal angle of attack $b \approx 10\%$ to 40% of c (2)

$a/c > 1$ (3).

2. Apparatus as claimed in claim 1 wherein the apparatus also conforms to at least one of the relationships:

$St = fA/U \approx 0.20$ to 0.45 where St is the Strouhal number $\psi \approx 70°$ to $110°$ for forward propulsion and $-70°$ to $-110°$ for reverse propulsion.

3. Apparatus as claimed in claim 2 wherein said apparatus conforms to at least two of the relationships (1)-(3).

4. Apparatus as claimed in claim 2 wherein said apparatus conforms to all of said relationships (1)-(3) in claim 1 and to both relationships in claim 2.

5. Apparatus as claimed in claim 2 wherein $St \approx 0.35$, $\alpha \approx 20°$, $b \approx 33\frac{1}{3}\%$ of c, $a/c \approx 1.5$ and $\psi = 75°$ (for forward motion in the selected direction).

6. Apparatus as claimed in claim 1 wherein said apparatus conforms to at least two of the relationships (1)-(3).

7. Apparatus as claimed in claim 1 wherein said apparatus conforms to all of said relationships (1)-(3).

8. Apparatus as claimed in claim 1 wherein there are a plurality of said foils, and wherein said means for oscillating oscillates said foils out of phase so that the average thrust of the foils in a direction transverse to said selected direction is substantially zero.

9. Apparatus as claimed in claim 8 wherein there are an even number of said foils, and wherein said means for oscillating oscillates half of said foils 180° out of phase with the other half of said foils.

10. Apparatus as claimed in claim 8 wherein each pair of adjacent foils are spaced by a minimum distance of approximately 3 c.

11. Apparatus as claimed in claim 1 wherein the linear position Y(t) of a foil at a time t and the pitch angle $\theta(t)$ of a foil at time t are substantially $$Y(t) = a \sin(2\pi ft)$$

$$\theta(t) = \theta_o \sin(2\pi ft + \psi) + \bar{\theta}$$

where $\bar{\theta}$ is a bias angle which is substantially zero for propulsion in the selected direction.

12. Apparatus as claimed in claim 11 wherein the bias angle $\bar{\theta}$ is variable between angles of $\pm 10°$.

13. Apparatus as claimed in claim 1 wherein the apparatus is being utilized to propel a vessel in water, wherein the vessel has a minimum draft of H, and wherein the foil span S is less than H.

14. Apparatus as claimed in claim 13 wherein $S \sim 0.8$ H.

15. Apparatus as claimed in claim 1 including means for storing energy during part of each oscillating cycle of a foil and for utilizing the stored energy during another part of the cycle.

16. Apparatus as claimed in claim 1 including a drive element and mechanical linkages for operating both the heave mechanism and the pitch mechanism from said drive element.

17. Apparatus as claimed in claim 16 wherein said pitch mechanism includes a mechanism for selectively imposing a bias angle on at least one foil to alter the propulsion direction.

18. Apparatus as claimed in claim 16 wherein said mechanical linkages include a mechanism for changing the sign of the phase angle $\psi$ to control the propulsion direction.

19. Apparatus as claimed in claim 16 wherein the heave mechanism includes a mechanism for selectively controlling the heave amplitude a.

20. Apparatus as claimed in claim 16 wherein the pitch mechanism includes a mechanism for selectively controlling the maximum pitch angle $\theta_o$.

21. A method for providing propulsion in a fluid, said propulsion being in a selected direction at a speed U, the method utilizing at least one foil having an average chord c, an average span S, a leading edge facing on average in said selected direction, a trailing edge facing in a direction opposite said leading edge and a pivot point spaced by a distance b from said leading edge, the method comprising the steps of:

oscillating said at least one foil at a frequency f and with an amplitude a in a direction substantially transverse to said selected direction; and flapping said at least one foil about its pivot point to change its pitch angle to said selected direction with a smooth periodic motion at substantially said frequency f through an angle from $+\theta_o$ to $-\theta_o$, there being a phase angle $\psi$ between the pitch angle of the foil and its transverse oscillation, and the total excursion A of the trailing edge of the foil being such that $$A \simeq 2\sqrt{a^2 + (c-b)^2 - 2a(c-b)\cos\psi}\ ;$$

the method substantially conforming to at least one of the following relationships:

$$\alpha \simeq \sqrt{\left(\frac{2\pi fa}{U}\right)^2 + \theta^2{}_o - 2\theta_o \frac{2\pi fa}{U} \sin\psi} \simeq 10° \text{ to } 22° \quad (1)$$

where $\alpha$ is the nominal angle of attack $b \approx 10\%$ to $40\%$ of c (2)

$a/c > 1$ (3).

22. A method as claimed in claim 23 wherein the method also substantially conforms to at least one of the relationships:

$St = fA/U \approx 0.20$ to $0.45$ where St is the Strouhal number $\psi \approx 70°$ to $110°$ for forward propulsion and $-70°$ to $-110°$ for reverse propulsion.

23. A method as claimed in claim 22 wherein said method conforms to all of the relationships (1)-(3) in claim 23 and to both relationships in claim 24.

24. A method as claimed in claim 21 wherein for a given one or more foils having a given span S which is less than the minimum draft of a vessel being propelled by the foils, including the steps of:

determining the area $A_o$ for each of the at least one foil from the relationship $A_o = C_r A_w / NC_t$ where $A_w$ is the wetted area of the vessel and where $C_r$ and $C_t$ are the resistance coefficient of the vessel and the trust coefficient of the at least one foil, respectively, and N is the number of foils; and determining the average chord c for each of the foils from the relationship $c = A_o/S$.

* * * * *